US005784006A

United States Patent [19]

Hochstein

[11] Patent Number: 5,784,006

[45] Date of Patent: Jul. 21, 1998

[54] ANNUNCIATOR SYSTEM WITH MOBILE RECEIVERS

[76] Inventor: Peter A. Hochstein, 2966 River Valley Dr., Troy, Mich. 48098

[21] Appl. No.: 676,055

[22] Filed: Jul. 5, 1996

[51] Int. Cl.[6] ..... G08G 1/09

[52] U.S. Cl. ..... 340/905; 340/928; 340/947; 375/240; 375/241; 455/25; 455/72

[58] Field of Search ..... 340/905, 928, 340/947, 948; 375/240, 241; 455/25, 72

[56] References Cited

U.S. PATENT DOCUMENTS

| | | | |
|---|---|---|---|
| Re. 21,818 | 6/1941 | Halstead . | |
| 3,582,933 | 6/1971 | Place | 340/903 |
| 3,710,313 | 1/1973 | Kimball et al. | 340/902 |
| 3,784,970 | 1/1974 | Simpkin | 340/902 |
| 3,867,718 | 2/1975 | Moe | 340/908 |
| 4,311,876 | 1/1982 | Endo et al. | 455/456 |
| 4,727,371 | 2/1988 | Wulkowicz | 340/905 |
| 4,816,827 | 3/1989 | Baloutch et al. | 340/905 |
| 4,921,468 | 5/1990 | Miwa | 340/905 |
| 4,926,170 | 5/1990 | Beggs et al. | 340/903 |
| 4,949,067 | 8/1990 | Martell | 340/905 |
| 5,214,793 | 5/1993 | Conway et al. | 340/905 |
| 5,444,742 | 8/1995 | Grabow et al. | 340/905 |
| 5,448,219 | 9/1995 | Yoshikawa et al. | 340/905 |
| 5,594,432 | 1/1997 | Oliva et al. | 340/905 |
| 5,633,629 | 5/1997 | Hochstein | 340/905 |
| 5,649,300 | 7/1997 | Snyder et al. | 340/905 |
| 5,673,039 | 9/1997 | Pietzsch et al. | 340/905 |

*Primary Examiner*—Thomas J. Mullen, Jr.
*Assistant Examiner*—Daniel J. Wu
*Attorney, Agent, or Firm*—Howard & Howard

[57] ABSTRACT

A system for annunciating traffic information includes a plurality of stationary transmitters (42,46) for generating relatively short range, highly directional beam signals (44, 48) containing a burst data stream signal (10) to each of a plurality of mobile receivers (50,52,54). The stationary transmitter (42) includes a transmitter (42*a*) connected to a transmitter antenna (56) for generating the beam signal (44) and to a transmitter control (60) which is connected to a transmitter memory (68) for storing a plurality of compressed data voice messages which are read by the transmitter control and generated as data packet signals (16,20, 22) in the burst data stream signal (10). The mobile receiver (54) includes a receiver antenna (58) for receiving the beam signal (44), a receiver (54*a*) for separating the burst data stream signal (10) from the beam signal, a receiver control (70) for reading the data packet signals, a data decompression circuit (72) for decompressing the data packet signals and an audio playback device (78) for audibly reproducing the messages. A traffic signal (36) connected to the transmitter control (60) generates traffic signal state signals which are generated as status flag signals (14,28) in the burst data stream signal (10) and the receiver control (70) responds to the status flag signals by generating a traffic signal state indication from an output device (80).

26 Claims, 2 Drawing Sheets

ANNUNCIATOR SYSTEM WITH MOBILE RECEIVERS

BACKGROUND OF THE INVENTION

The present invention relates generally to an apparatus for transmitting information to mobile receivers and, in particular, to an apparatus for annunciating traffic information.

Radio traffic advisory systems have been used for many years to alert drivers to special attractions or warn drivers of traffic problems. Short range AM or FM transmitters are used in state and national parks to inform visitors of certain features or to broadcast special directives.

Generally, the messages are fairly long and may be heard on certain broadcast band radio stations (the frequencies of which are posted on roadside signs). The operational range of these highway information systems is such that any vehicle in the general vicinity of the transmitting antenna is able to receive the broadcast irrespective of the direction of travel. That is, the broadcast is essentially omnidirectional.

There is a great need for annunciator systems, for highway use in particular, that are very site specific and direction specific. For example, at a given intersection a certain traffic message may be appropriate for Northbound traffic, but not appropriate for travelers in other directions. Furthermore, announcements at given intersections may be inappropriate at intersections only a few hundred feet away. Such site specificity is particularly important in densely populated urban areas.

Traditional broadcast band (AM or FM) frequencies are not very useful for such short range, highly directional use because practical antennas for these bands are not narrowly directive. Microwave or infrared carrier frequencies are more useful for such purposes, and can be made highly directional. At radio frequencies above 10 GHz, and in the infrared spectrum, radiation behaves similar to visible light, and can be conveniently focused or directed with simple, compact antenna structures. Reflectors, lenses and similar hardware can be used to confine the transmission and reception of these wavelengths to very specific areas. Relatively low radiated power from the transmitter limits the range so that frequency reuse is practical several hundred meters or even tens of meters away.

Certainly the technology for such short range links is clearly in place, and in fact some experimental roadside signpost systems use short range transmission to send digital position data to vehicular receivers. Such on-board navigation schemes rely on periodic positional updating for maintaining absolute accuracy of dead reckoning navigation engines. However, digital maps and moving cursors are notoriously intrusive, and there is some evidence that the safety of the driver and passengers may become an issue if moving maps or alpha numeric displays become commonplace.

An ideal annunciator system would use audio messaging as is used in local radio advisory systems, but with distinct area and direction specificity. The problem with adapting short range microwave or infrared transmission to deliver specific voice messages is that the receiver must stay in range of the transmitter for the duration of the broadcast message or messages. In real terms, such an arrangement is impractical because in all but the slowest moving traffic, the residence time of the mobile receivers would be too short to receive a reasonable message. That is, the mobile receiver would be in range of a particular transmitter for only seconds if the vehicle was moving anywhere close to typical speeds.

SUMMARY OF THE INVENTION

The present invention concerns an apparatus for annunciating information to mobile receivers which includes a plurality of spaced apart stationary transmitters each generating relatively short range, highly directional beam signals to a plurality of mobile receivers for receiving the beam signals. The stationary transmitters include a transmitter means for transmitting a burst data stream signal, a transmitter antenna means connected to the transmitter means for transmitting the beam signal in response to the burst data stream signal, a transmitter control means connected to the transmitter means and a transmitter memory means connected to the transmitter control means for storing a plurality of compressed data voice messages. The transmitter control means selectively reads the messages from the transmitter memory means and generates the messages as data packet signals in a predetermined sequence in the burst data stream signal. A traffic signal means can be connected to the transmitter control means for generating traffic signal state signals wherein the transmitter control means responds to the traffic signal state signals to generate status flag signals in the burst data stream signal. The mobile receivers include a receiver antenna means for receiving the beam signal, a mobile receiver means connected to the receiver antenna means for separating the burst data stream signal from the beam signal, a receiver control means connected to the mobile receiver means for reading the data packet signals from the mobile receiver means, a data decompression means connected to the receiver control means for decompressing the data packet signals, a receiver memory means connected to the data decompression circuit and to the receiver control means for storing the messages in decompressed form and an audio playback device connected to the receiver control means for audibly reproducing the messages.

The burst data stream signal is generated as a serial string of predetermined length information windows, each window having an initial portion containing one of the status flag signals and a subsequent portion for containing a selected one of the data packet signals. The receiver control means responds to the status flag signals by generating a traffic signal state indication from an output means connected to the receiver control means.

BRIEF DESCRIPTION OF THE DRAWINGS

The above, as well as other advantages of the present invention, will become readily apparent to those skilled in the art from the following detailed description of a preferred embodiment when considered in the light of the accompanying drawings in which.

DESCRIPTION OF THE PREFERRED EMBODIMENT

Figure 1:
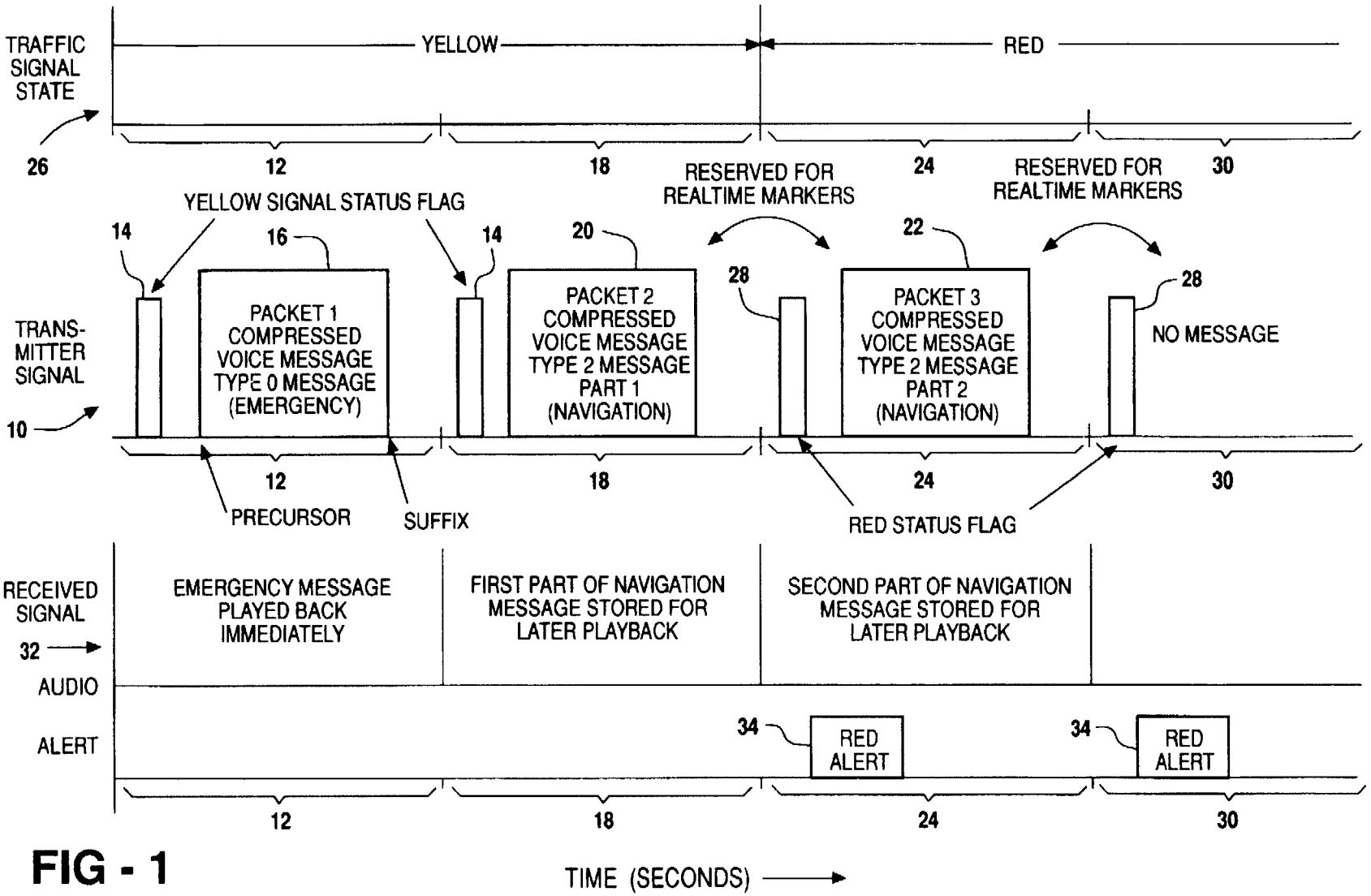
FIG. 1 is a wave form diagram of signals generated by an annunciator system in accordance with the present invention.

The present invention solves the receiver "residence time" problem by operating the transmitter in a "burst mode". Such operation allows the transmitter to transmit time compressed voice signals to a special receiver. The receiver demodulates this compressed voice data and stores it in a digital memory for later playback at normal rates. Note that such a system does not operate in real time, but delivers the message some time after it was transmitted. This signal processing delay may be very short and in virtually all cases is not very important.

Modern speech processing circuits and in particular ASICs (application specific integrated circuits) for speech recording and playback allow such burst communication protocols to be implemented at very low cost. Advances in speech compression, and in linear predictive coding, permit the digitized speech message to be broadcast over a relatively narrow bandwidth. For example, modern digital speech codecs (coders—decoders) are able to convey high quality speech with a digitizing rate of only 7 KHz, which is amazing considering that telephone voice grade lines exhibit an analog bandwidth of less than 4 KHz. The importance of conserving bandwidth is evident when time compressed or burst mode transmission is needed to convey relatively long messages in short time intervals.

While digital data burst mode communication is common, the time-compressed transmission of voice messages has not been practical until the advent of advanced speech processing integrated circuits and low cost playback devices. A digital, burst mode, voice messaging system would operate on the following principle: A voice message of 10 seconds (for purposes of illustration) would be compressed, digitized and stored in a solid state memory (EPROM or OTP etc.). This message would also typically be annotated with coded precursors and suffixes that identify the message, the type of message, the length of message and other utility functions.

At the transmitter, the digital data from the storage device would be broadcast in burst mode by clocking the data out of the memory at a substantially higher rate than the baseband (voice) signal was recorded. For example, the 7 KHz (more accurately 7 Kbps) rate of recording could be broadcast at 70 Kbps or even 140 Kbps, so that a 10 second message would be broadcast in 1 second or even 0.5 seconds of actual transmission time.

At the receiver, the digital data would be stored in solid state memory for later playback. As the data is clocked out of the storage I.C., at a relatively slow rate, it is converted back to an analog signal that may convey an audible message. Depending upon the type or nature of the message, as annotated by specific codes, the received data may be either stored for later playback or be converted immediately into an audible message or alarm. In fact, the use of a number of "mail boxes" in the receiver would allow various types of messages to be stored in separate registers (memory) so that the user could selectively access these messages at will.

For example, emergency messages would be coded with specific precursors or suffixes to direct them to channel 0 for immediate playback, while tourist information would be stored in channel 1, navigation or directional information in channel 2, commercial (advertising) in channel 3, etc. At the users' option, any or all of the memory channels (mail boxes) may be accessed as received or at a later time (except, of course channel 0). Each channel or mail box could store any number of messages, which, unless purposely erased, would eventually be overwritten by the most recent messages.

While the primary function of the burst communication system described here is the delivery of audible messages, digital data or alphanumeric information could also be transmitted to appropriate receivers. A combination of voice messages and alphanumeric data would be of value to drivers if a telephone number was transmitted for example. The wide proliferation of mobile telephones would allow drivers to call ahead for restaurant or lodging reservations without having to write down or remember broadcast telephone numbers. A scrolling display on the receiver could be used as an electronic (self registering) notepad.

Another application of the burst annunciator system according to the present invention might be to immediately advise speeding motorists of their actual speed, which might cause them to slow down. An active, short range Doppler radar or time of flight laser speed sensing device (Lidar) would be coupled to a voice messaging unit. Such devices would be particularly useful in school zones, neighborhoods with special needs (deaf children) or similarly challenging safety zones. The utility of the burst communication as described for traffic advisory use would be greatly enhanced by the addition of "real time" markers to the compressed data stream.

As explained above, many messages (particularly those of a commercial nature) may be delayed seconds or even tens of minutes with little loss of utility. However, certain traffic information needs to be relayed immediately such as the actual disposition of a traffic control device. For example, red lights would have to be announced immediately, as would yellow and green signals, as well as railway crossing signals. As shown in the FIG. 1, the apparently incompatible demands for such a mixed system could be easily accommodated by recurring real time "flags" interspersed in the burst data stream. The periodic interval of these status flags would be short enough to provide essentially a real time relay of important signals, and to simultaneously permit the transmission of relatively long messages for subsequent playback.

For example, as shown in a middle portion of the FIG. 1, a burst data stream signal 10 can be transmitted at 100 KHz which provides a stream or serial string of information windows each 100 msec long. A first information window 12 contains a first status flag signal 14 in an initial portion thereof followed by a first data packet signal 16 in a subsequent portion thereof. The first data packet signal 16 can contain a compressed voice message of any type such as a code 0 (emergency message) identified by a precursor and/or suffix. A second information window 18 follows the first window 12 and contains a status flag signal 14 in an initial portion thereof followed by a second data packet signal 20 in a subsequent portion thereof. The second data packet signal 20 can contain a compressed voice message of any type such as a code 2 (navigation message). Thus, status flag signals can be transmitted every 100 msec in the reserved initial portion of each window. The periodic transmission of status flags would insure that the reception of important signals would be no further than 100 msec away from the time a receiver begins to receive the transmitted signal containing the burst data stream 10.

Note that during the transmission of relatively long messages, the message may be split between two or more data packets. If the navigation message is relatively long, a first part may be included in the second data packet signal 20 and a second part included in a third data packet 22 contained in a third information window 24. The status flag signals 14 represent a monitored parameter of interest to the person receiving the burst data stream 10. There is shown above the wave form 10, a plot 26 of the state of a traffic signal associated with the transmitter generating the burst data stream. Thus, the status flag signal 14 can represent a yellow light state of the traffic signal. During a long voice message spanning at least two windows, the status flags could change reflecting a change in the monitored parameter. As shown, the state of the traffic signal changes from yellow to red at approximately the end of the second window 18. Accordingly, a second status flag signal 28 is generated in the initial portion of the third window 24 representing the red light state of the associated traffic signal. The second status flag signal 28 is generated again in the initial portion of a fourth information window 30 indicating that the traffic signal is still red. The fourth information window 30 is shown as not containing a data packet signal which represents a situation wherein no message is to be transmitted to the receiver or a window reserved only for code 0 emergency messages.

There is shown below the burst data stream signal wave form 10 a plot 32 of the response of a mobile receiver to the data packet signals 16, 20 and 22 and to the status flag signals 14 and 28. During the first information window 12, the receiver receives the first data packet signal 16. A control associated with the receiver recognizes that the first data packet signal 16 is a code 0 emergency message and, therefore, decodes and plays back the voice message immediately while the subsequent data packet signals 20 and 22 are being received. While the first data packet signal 16 is being processed, the second data packet 20, the third data packet 22 and any other data packets which are received are stored in a memory for later playback. The control also recognizes the second status flag signal 28 and responds by generating a red light alert signal 34 which can be utilized to generate a visual and/or an audio output to warn the person adjacent the mobile receiver of the changed status of the traffic signal.

A system such as that described above could be applied to pedestrian signals that also announce their location or provide pertinent tourist information. Portable receivers could be provided to visually impaired pedestrians as a mobility aid. Such a carried data receiver would respond immediately to the change in "walk" or "don't walk" signals, but could generate a compressed voice message for later playback.

Unimportant messages would be preempted by critical (safety) messages so that the user could respond instantly to such announcements. The preemption of commercial or less important messages is only temporary as the burst (voice) message is stored in digital memory and can be played back at anytime until it is purposely erased.

Figure 2:
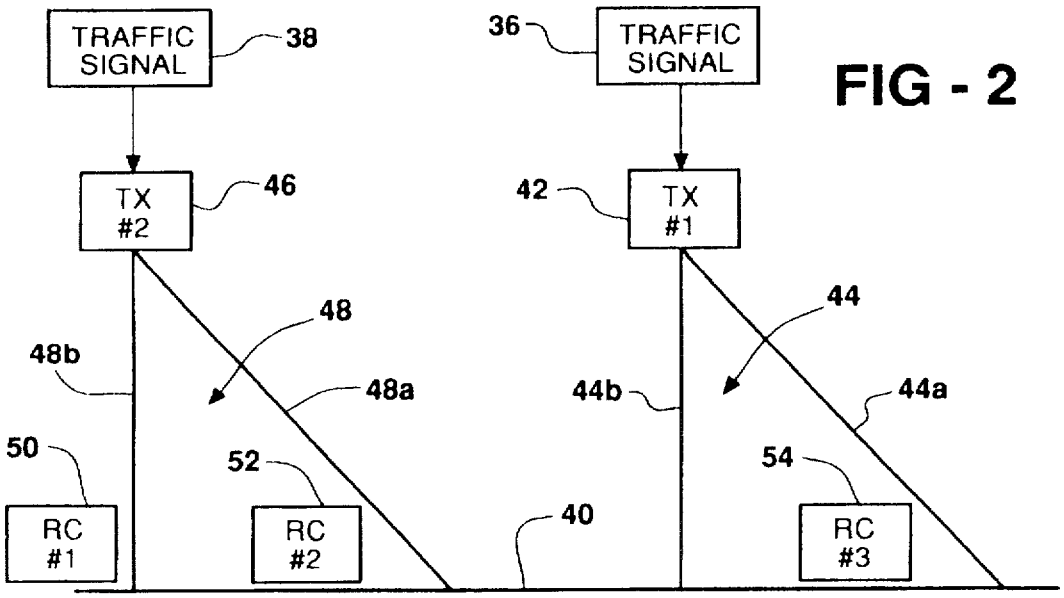
FIG. 2 is a schematic view of an annunciator system according to the present invention utilized to convey traffic information.

There is shown in the FIG. 2 a schematic view of an annunciator system according to the present invention utilized to provide traffic information to mobile receivers. First and second traffic signals 36 and 38 respectively are spaced apart along a roadway 40. The first traffic signal 36 is connected to a first stationary transmitter 42 (TX #1) which broadcasts a relatively short range, highly directional beam signal 44 extending between a leading edge **44*a* directed toward the right and a trailing edge 44*b* directed downwardly. Thus, the beam 44 is directed toward receivers approaching the first traffic signal 36 from the right. The second traffic signal 38 is connected to a second stationary transmitter 46 (TX #2) which generates a relatively short range, highly directional beam signal 48 extending between a leading edge 48*a* directed toward the right and a trailing edge 48*b* directed downwardly. Thus, the beam 48 is directed toward mobile receivers approaching the second traffic signal 38 from the right. Typically, the beams 44 and 48** do not overlap so that a moving receiver is not confused by conflicting messages from two different transmitters.

A first mobile receiver 50 (RC #1) has passed through both of the beams 44 and 48 and is positioned to the left of the trailing edge **48*b*. Thus, the first receiver 50 is not receiving any messages. A second mobile receiver 52 (RC #2) has passed through the first beam 44 and is positioned in the second beam 48 to receive messages being broadcast by the second transmitter 46 including status flag signals representing the status of the second traffic signal 38. A third mobile receiver 54 (RC #3) is positioned in the first beam 44 to receive messages being broadcast by the first transmitter 42 including status flag signals representing the status of the first traffic signal 36. As shown in the FIG. 2, the beam signals 44 and 48 can be directed to portable receivers which are positioned within a predetermined area adjacent the transmitters 42 and 46** respectively to selectively provide messages to such receivers.

Figure 3:
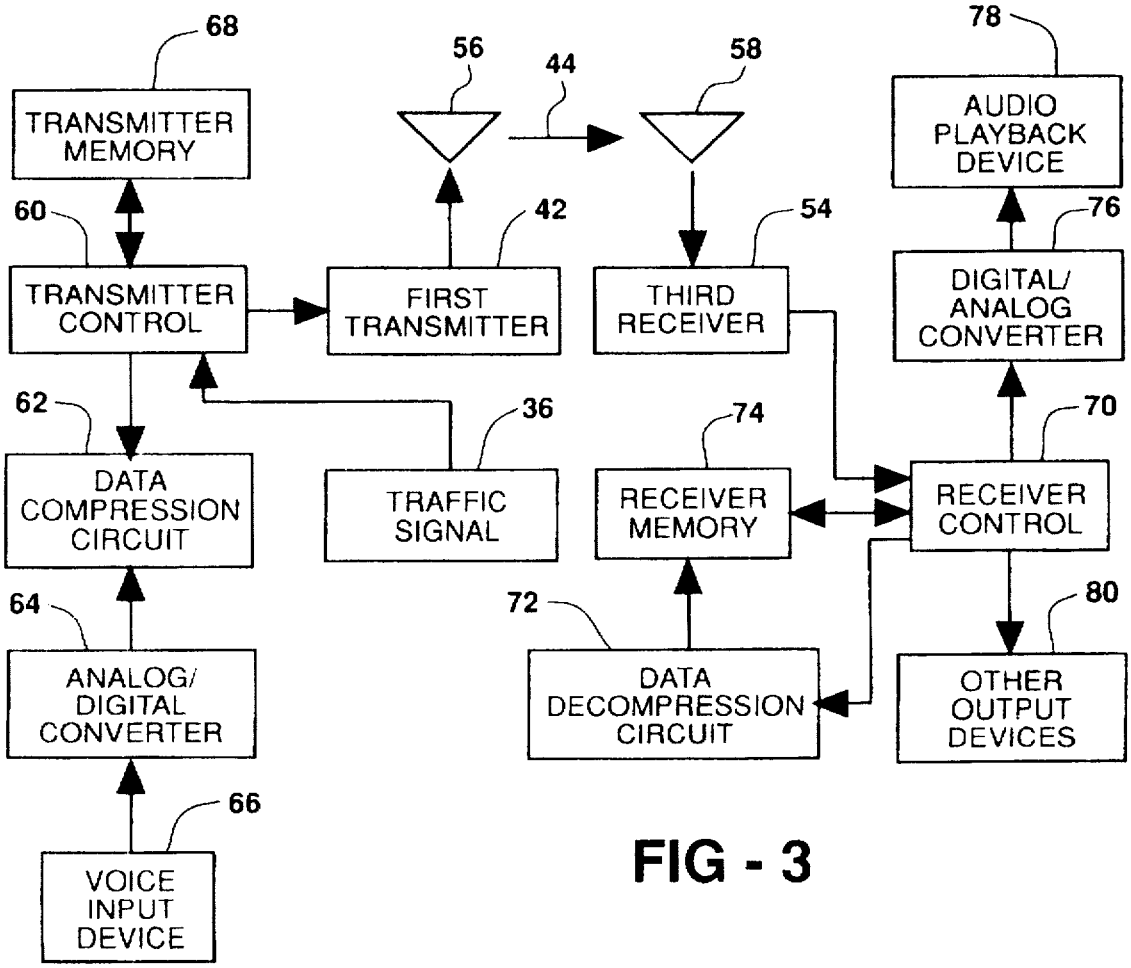
FIG. 3 is a detailed schematic block diagram of the annunciator system shown in the FIG. 2.

There is shown in the FIG. 3 a schematic block diagram of a portion of the annunciator system shown in the FIG. 2. The first transmitter 42 includes a first transmitter means **42*a* having an output connected to a transmitter antenna 56 for transmitting the first beam signal 44 to a receiving antenna 58 connected to an input of a third receiver means 54*a* in the third receiver 54. The transmitter 42*a* has an input connected to an output of a transmitter control 60 which generates the burst data stream 10 containing the status flag signals and the data packet signals to modulate the carrier signal generated by the transmitter. The transmitter control 60 has an input connected to an output of the first traffic signal 36 for receiving a signal representing the traffic signal state. The transmitter control 60 responds to the traffic signal state signal by generating the status flag signals 14 and 28 as shown in burst data stream 10 of the FIG. 1**.

A first input/output of the transmitter control 60 is connected to an input/output of a data compression circuit 62. The circuit 62 has an input connected to an output of a analog/digital converter 64 which has an input connected to an output of a voice input device 66. The voice input device 66 can be any device which converts sound waves into an analog electrical signal such as a microphone. The converter 64 responds to the analog signal by generating a digital signal representing the audio information in the analog signal. The data compression circuit 62, under the direction of the transmitter control 60, compresses the data in the digital signal and the compressed data is read by the transmitter control 60. A second input/output of the transmitter control 60 is connected to an input/output of a transmitter memory 68. The control 60 sends the compressed data received from the data compression circuit 62 and the traffic signal state signal received from the traffic signal 36 to the memory 68 for storage therein. The transmitter control 60 then utilizes the information stored in the transmitter memory 68 to form the burst data stream 10 shown in the FIG. 1.

The third receiver means **54*a* has an output connected to an input of a receiver control 70. The receiver 54*a* demodulates the burst data stream 10 containing the status flag signals and the data packet signals from the carrier signal generated by the first transmitter 42*a*. The receiver control 70 has a first output connected to an input of a data decompression circuit 72 and reads the data packet signals from the receiver 54*a* to the data decompression circuit for decompressing the compressed data. The circuit 72 has an output connected to an input of a receiver memory 74 wherein the status flag signals and the decompressed data packet messages are then stored. The receiver control 70 has an input/output connected to an input/output of the receiver memory 74 for reading the stored status flag signals and message data. The receiver control has a second output connected to an input of a digital/analog converter 76 which changes the digital data from the receiver control 70 into analog electrical signals at an output connected to an input of an audio playback device 78. Thus, the voice messages sent by the transmitter 42 can be heard by a person utilizing the receiver 54. A third output of the receiver control 70 is connected to an input of other output devices 78 which can be, for example, lights corresponding to the traffic signal lights and actuated by the red light alert signal 34 shown in the FIG. 1. Although the data compression circuit 72 is shown as being connected between the receiver control 70 and the receiver memory 74, the messages can be stored in compressed form and sent through the circuit 72 to the digital/analog converter 76** to be annunciated.

Prior to installation of the annunciator system according to the present invention, the voice input device 66, the analog/digital converter 64 and the data compression circuit 62 are utilized to create a predetermined set of messages which are stored in the transmitter memory 68. This operation can be performed with the transmitter control 60, or with a computer connected between the circuit 62 and the memory 68. For example, a personal computer equipped with a Blaster® AWE32™ audio card and microphone available from Creative Labs, Inc. of Milpitas, Calif. can be used to create the messages. Then the first transmitter 42, the transmitter antenna 56, the transmitter control 60 and the transmitter memory 68 are connected to the first traffic signal 36 at the location of the traffic signal along the roadway. The transmitter control 60 is programmed to continuously generate the burst data stream 10 shown in the FIG. 1 having a serial string of predetermined length information windows. The traffic signal 36 provides the traffic control with the traffic signal state information necessary to generate the status flag signals. The data packet signals can be generated in response to different stimuli. For example, the traffic signal 36 typically is connected to a traffic controller which receives information from a central source in order to properly sequence the traffic signals in a given area for efficient traffic flow. Such a controller can send control signals through the traffic signal 36 to direct the transmitter control 60 to select one or more of the compressed voice messages stored in the transmitter memory 68 to be broadcast as the data packet signals. The control signals also can be broadcast to the transmitter control 60 by connecting an input of the transmitter control to a suitable receiver and antenna. The transmitter control 60 can be preprogrammed to broadcast each of the code 1 (tourist information), code 2 (navigation or directional information) and code 3 (commercial information) messages in a predetermined cyclic sequence which can be interrupted by a code 0 (emergency information) message which is inserted into the next window generated in the burst data stream 10. Alternatively, the burst data stream 10 can be generated with periodic open windows 30 which are reserved for code 0 messages. Likewise, the receiver control 70 can be preprogrammed to reproduce each of the code 1 (tourist information), code 2 (navigation or directional information) and code 3 (commercial information) messages stored in the receiver memory 74 at predetermined intervals or selectively broadcast only messages of a selected one of the codes. In either case, the annunciation of the lower priority code messages can be interrupted by a code 0 (emergency information) message.

In summary, a system for annunciating information to mobile receivers includes a plurality of spaced apart stationary transmitters 42,46 generating relatively short range, highly directional beam signals 44,48 respectively to a plurality of mobile receivers 50,52,54 for receiving the beam signals. At least one stationary transmitter 42 includes a transmitter means **42*a* for transmitting a burst data stream signal 10, a transmitter antenna means 56 connected to the transmitter means 42*a* for transmitting the beam signal 44 in response to the burst data stream signal 10, a transmitter control means 60 connected to the transmitter means 42*a* and a transmitter memory means 68 connected to the transmitter control means 60 for storing a plurality of compressed data voice messages whereby the transmitter control means selectively reads the messages from the transmitter memory means and generates the messages as data packet signals 16,20,22 in a predetermined sequence in the burst data stream signal 10. A traffic signal means 36 can be connected to the transmitter control means 60 for generating traffic signal state signals wherein the transmitter control means responds to the traffic signal state signals to generate status flag signals 14,28 in the burst data stream signal 10. At least one mobile receiver 54 includes a receiver antenna means 58 for receiving the beam signal 44, a mobile receiver means 54*a* connected to the receiver antenna means 58 for separating the burst data stream signal 10 from the beam signal 44, a receiver control means 70 connected to the mobile receiver means 54*a* for reading the data packet signals 16,20,22 from the mobile receiver means, a data decompression means 72 connected to the receiver control means 70 for decompressing the data packet signals 16,20,22, a receiver memory means 74 connected to the data decompression circuit 72 and to the receiver control means 70 for storing the messages in decompressed form and an audio playback device 78 connected to the receiver control means 70** for audibly reproducing the messages.

The burst data stream signal 10 is generated as a serial string of predetermined length information windows 12,18, 24,30, each window having an initial portion containing one of the status flag signals 14,28 and a subsequent portion for containing a selected one of the data packet signals 16,20,22. The receiver control means 70 responds to the status flag signals 14,28 by generating a traffic signal state indication from an output means 80 connected to the receiver control means.

The present invention also includes a method for annunciating information to mobile receivers including the steps of: a. storing a plurality of compressed data voice messages in a transmitter memory means 68; b. generating a burst data stream signal 10 from a transmitter means **42*a*; c. selectively reading one of the stored messages from the transmitter memory means 68 and generating the one message as a data packet signal 16,20,22 in the burst data stream signal 10; d. transmitting a relatively short range, highly directional beam signal 44 from an antenna means 56 in response to the burst data stream signal 10; and e. receiving and decompressing the data packet signal 16,20,22 with a mobile receiver 54 entering the beam signal 44 for annunciating the one message. The method also includes a step of generating status flag signals 14,28 in the burst data stream signal 10, the status flag signals representing important information. The step b. is performed by generating the burst data stream signal 10 as a serial string of predetermined length information windows 12,18,24,30, each of the windows having an initial portion for containing one of the status flag signals 14,28 and a subsequent portion for containing a selected one of the data packet signals 16,20,22. The method includes repeating the step c. for selected ones of the stored messages and coding the data packet signals 16,20,22 according to a predetermined priority. The step e. includes selecting messages associated with the data packet signals 16,20,22 having a predetermined code for annunciation and immediately annunciating messages associated with the data packet signals 16** having a predetermined code.

In accordance with the provisions of the patent statutes, the present invention has been described in what is considered to represent its preferred embodiment. However, it should be noted that the invention can be practiced otherwise than as specifically illustrated and described without departing from its spirit or scope.

What is claimed is:

1. An apparatus for annunciating information to mobile receivers comprising:

A control means (60) for generating a plurality of data packet signals (16,20,22) containing compressed data voice messages and a code for each data packet signal (16,20 22);

a transmitter means (42*a*) for transmitting said coded data packet signals (16,20, 22) in a burst data stream (10);

a receiver (54) for receiving and decompressing the burst data stream (10); and a control means (70) for reading and separating the coded data packet signals (16,20,22) according to code and selectively annunciating messages of a predetermined code.

2. A method for annunciating information to mobile receivers comprising the steps of:

a. generating a plurality of data packet signals (16,20,22) containing compressed data voice messages;

b. generating a code with each of said data packet signals (16,20,22);

c. transmitting said coded data packet signals (16,20,22) in a burst data stream (10) from a transmitter (42*a*);

d. receiving and decompressing the burst data stream (10);

e. separating said coded data packet signals (16,20,22); and f. selectively annunciating messages of a predetermined code.

3. An apparatus for annunciating information to mobile receivers comprising:

a transmitter means (42*a*) for generating a burst data stream signal (10);

an antenna means (56) connected to said transmitter means (42*a*) for transmitting a relatively short range, highly directional beam signal (44) in response to said burst data stream signal (10);

a transmitter control means (60) connected to said transmitter means (42*a*); and a transmitter memory means (68) connected to said transmitter control means (60) for storing a plurality of compressed data voice messages whereby said transmitter control means selectively reads at least one of said messages from said transmitter memory means and generates said one message as a data packet signal (16,20,22) in said burst data stream signal (10), said data packet signal to be received and decompressed by a mobile receiver (54) entering said beam signal (44) for annunciating said one message; and wherein said messages are coded as to priority and said transmitter control means (60) generates a higher priority one of said messages as one data packet signal (16) before generating a lower priority one of said messages as another data packet signal (20,22).

4. The apparatus according to claim 3 wherein at least another one of said messages is coded as a highest priority emergency information message and said transmitter control means (60) generates each of said lower priority messages as said another data packet signal (20,22) in a predetermined cyclic sequence and interrupts said predetermined cyclic sequence with said one data packet signal (16).

5. An apparatus for annunciating traffic information comprising:

a stationary transmitter means (42*a*) for generating a burst data stream signal (10) at an output, a transmitter antenna means (56) connected to said output of said transmitter means (42*a*) for generating a relatively short range, highly directional beam signal (454) in response to said burst data stream signal(10);

a transmitter control means (60) connected to said transmitter means (42*a*);

a transmitter memory means (68) connected to said transmitter control means (60) for storing a plurality of compressed data voice messages, at least one of said messages representing traffic information whereby said transmitter control means reads said one message from said transmitter memory means and generates said one message as a data packet signal (16, 20,22) in said burst data stream signal (10);

a receiver antenna means (58) for receiving said beam signal (44);

a mobile receiver means (54*a*) having an input connected to said receiver antenna means (58) for separating said burst data stream signal (10) from said beam signal (44); a receiver control means (70) connected to said mobile receiver means (54*a*) for reading said data packet signal (16,20,22) from said mobile receiver means;

a data decompression means (72) connected to said receiver control means (70 for receiving and decompressing said data packet signal (16,20,22); and an audio playback device (78) connected to said receiver control means (70) for audibly reproducing said one message from said decompressed data packet signal (16,20,22), and wherein said messages are coded as to priority and said transmitter control means (60) generates a higher priority of one of said messages as one data packet signal (16) before generating a lower priority of one of said messages as another data packet signal (20,22) and said receiver control means (70) sends said higher priority message associated with said one data packet signal (16) to said audio playback means (78) before sending said lower priority message associated with said another data packet signal (20,22) to said audio playback means.

6. The apparatus according to claim 5 including a receiver memory means (74) connected to said data decompression circuit (72) and to said receiver control means (70) for storing said one message in decompressed form.

7. An apparatus for annunciating traffic information comprising:

a stationary transmitter means (42*a*) for generating a burst data stream signal (10) at an output:

a transmitter antenna means (56) connected to said output of said transmitter means (42*a*) for generating a relatively short range, highly directional beam signal (454) in response to said burst data stream signal(10);

a transmitter control means (60) connected to said transmitter means (42*a*);

a transmitter memory means (68) connected to said transmitter control means (60 for storing a plurality of compressed data voice messages, at least one of said messages representing traffic information whereby said transmitter control means reads said one message from said transmitter memory means and generates said one message as a data packet signal (16, 20,22) in said burst data stream signal (10);

a receiver antenna means (58) for receiving said beam signal (44);

a mobile receiver means (54*a*) having an input connected to said receiver antenna means (58) for separating said burst data stream signal (10) from said beam signal (44);

a receiver control means (70) connected to said mobile receiver means (54*a*) for reading said data packet signal (16,20,22) from said mobile receiver means;

a data decompression means (72) connected to said receiver control means (70) for receiving and decompressing said data packet signal (16,20,22); and an audio playback device (78) connected to said receiver control means (70) for audibly reproducing said one message from said decompressed data packet signal (16,20,22); and a traffic signal means (36) connected to said transmitter control means (60) for generating a traffic signal state signal and wherein said transmitter control means responds to said traffic signal state signal to generate a status flag signal (14,28) in said burst data stream signal (10) and said receiver control means (70) responds to said status flag signal by generating a traffic signal state indication from an output means (80) connected to said receiver control means.

8. The apparatus according to claim 7 wherein said burst data stream signal (10) is generated as a serial string of predetermined length information windows (12,18,24,30), each said window having an initial portion for containing said status flag signal (14,28) and a subsequent portion for containing said data packet signal (16,20,22).

9. A system for annunciating information to mobile receivers comprising:

a plurality of spaced apart stationary transmitters (42,46) generating relatively short range, highly directional beam signals (44,48) respectively;

at least one said stationary transmitter (42) including a transmitter means (42*a*) for transmitting a burst data stream signal (10), a transmitter antenna means (56) connected to said transmitter means (42*a*) for transmitting said beam signal (44) in response to said burst data stream signal (10), a transmitter control means (60) connected to said transmitter means (42*a*) and a transmitter memory means (68) connected to said transmitter control means (60) for storing a plurality of compressed data voice messages whereby said transmitter control means selectively reads said messages from said transmitter memory means and generates said messages as data packet signals (16,20,22) in a predetermined sequence in said burst data stream signal (10);

a traffic signal means (36) connected to said transmitter control means (60) for generating traffic signal state signals and wherein said transmitter control means responds to said traffic signal state signals to generate status flag signals (14,28) in said burst data stream signal (10);

a plurality of mobile receivers (50,52,54) for receiving said beam signals (44,48); and at least one said mobile receiver (54) including a receiver antenna means (58) for receiving said beam signal (44), a mobile receiver means (54*a*) connected to said receiver antenna means (58) for separating said burst data stream signal (10) from said beam signal (44), a receiver control means (70) connected to said mobile receiver means (54*a*) for reading said data packet signals (16,20,22) from said mobile receiver means, a data decompression means (72) connected to said receiver control means (70) for decompressing said data packet signals (16,20,22), a receiver memory means (74) connected to said data decompression circuit (72) and to said receiver control means (70) for storing said messages in decompressed form and an audio playback device (78) connected to said receiver control means (70) for audibly reproducing said messages.

10. The system according to claim 9 wherein said burst data stream signal (10) is generated as a serial string of predetermined length information windows (12,18,24,30), each said window having an initial portion for contains one of said status flag signals (14,28) and a subsequent portion for containing a selected one of said data packet signals (16,20,22).

11. The apparatus according to claim 9, wherein said receiver control means (70) responds to said status flag signals (14,28) by generating a traffic signal state indication from an output means (80) connected to said receiver control means.

12. A method for annunciating information to mobile receivers comprising the steps of:

a. storing a plurality of compressed data voice messages in a transmitter memory means (68);

b. generating a burst data stream signal (10) from a transmitter means (42*a*);

c. selectively reading one of the stored messages from the transmitter memory means (68) and venerating the one message as a data packet signal (16,20,22) in the burst data stream signal (10);

d. transmitting a relatively short range, highly directional beam signal (44) from an antenna means (56) in response to the burst data stream signal (10);

e. receiving and decompressing the data packet signal (16,20,22) with a mobile receiver (54) entering the beam signal (44) for annunciating the one message; and f. generating status flag signals (14,28) in the burst data stream signal (10), the status flag signals representing important information.

13. The method according to claim 12 wherein said step b. is performed by generating the burst data stream signal (10) as a serial string of predetermined length information windows (12,18,24,30), each of the windows having an initial portion for containing one of the status flag signals (14,28) and a subsequent portion for containing a selected one of the data packet signals (16,20,22).

14. The method according to claim 12 including repeating said step c. for selected ones of the stored messages.

15. A method for annunciating information to mobile receivers comprising the steps of:

a. storing a plurality of compressed data voice messages in a transmitter memory means (68);

b. generating a burst data stream signal (10) from a transmitter means (42*a*);

c. selectively reading one of the stored messages from the transmitter memory means (68) and generating the one message as a data packet signal (16,20,22) in the burst data stream signal (10);

d. transmitting a relatively short range, highly directional beam signal (44) from an antenna means (56) in response to the burst data stream signal (10);

e. receiving and decompressing the data packet signal (16.20.22) with a mobile receiver (54) entering the beam signal (44) for annunciating the one message; and f. coding the data packet signals (16.20.22) according to a predetermined priority.

16. The method according to claim 15 wherein said step e. includes selecting messages associated with the data packet signals (16.20.22) having a predetermined code for annunciation.

17. The method according to claim 15 wherein said step e. includes immediately annunciating messages associated with the data packet signals (16) having a predetermined code.

18. An apparatus for annunciating information to mobile receivers comprising:

a transmitter means (42*a*) for generating a burst data stream signal (10);

an antenna means (56) connected to said transmitter means (42*a*) for transmitting a relatively short range, highly directional beam signal (44) in response to said burst data stream signal (10);

a transmitter control means (60) connected to said transmitter means (42*a*) and a transmitter memory means (68) connected to said transmitter control means (60) for storing a plurality of compressed data voice messages whereby said transmitter control means selectively reads at least one of said messages from said transmitter memory means and generates said one message as a data packet signal (16.20.22) in said burst data stream signal (10), said data packet signal to be received and decompressed by a mobile receiver (54) entering said beam signal (44) for annunciating said one message; and wherein said transmitter means (42*a*) generates said burst data stream signal (10) as a serial string of predetermined length information windows (12.18.24.30) and said data packet signal (16.20.22) is positioned in a selected one of said windows.

19. The apparatus according to claim 18 including a traffic signal means (36) connected to said transmitter control means (60) for generating a traffic signal state signal and wherein said transmitter control means responds to said traffic signal state signal to generate a status flag signal (14.28) in each of said information windows (12.18.24.30).

20. The apparatus according to claim 18 including voice input means (62.64.66) connected to said transmitter memory means (68) for generating said compressed data voice messages.

21. The apparatus according to claim 20 wherein said voice input means (62.64.66) includes a voice input device (66) connected to an analog/digital converter (64) for converting sound into a digital signal and a data compression circuit (62) connected between said analog/digital converter (64) and said transmitter memory means (68) for generating said compressed data voice messages from said digital signal.

22. An apparatus for annunciating information to mobile receivers comprising:

a transmitter means (42*a*) for generating a burst data stream signal (10);

an antenna means (56) connected to said transmitter means (42*a*) for transmitting a relatively short range, highly directional beam signal (44) in response to said burst data stream signal (10);

a transmitter control means (60) connected to said transmitter means (42*a*); and a transmitter memory means (68) connected to said transmitter control means (60) for storing a plurality of compressed data voice messages whereby said transmitter control means selectively reads at least one of said messages from said transmitter memory means and generates said one message as a data packet signal (16.20.22) in said burst data stream signal (10), said data packet signal to be received and decompressed by a mobile receiver (54) entering said beam signal (44) for annunciating said one message; and a traffic signal means (36) connected to said transmitter control means (60) for generating a traffic signal state signal and wherein said transmitter control means responds to said traffic signal state signal to generate a status flag signal (14.28) in said burst data stream signal (10).

23. The apparatus according to claim 22 including a plurality of mobile receivers (50.52.54) receiving and decompressing said data packet signal (16.20.22) upon entering said beam signal (44) for audibly reproducing said one message.

24. The apparatus according to claim 22 including a mobile receiver means (54*a*), a receiver antenna means (58) for receiving said beam signal (44) and being connected to an input of said mobile receiver means, a data decompression means (72) connected to said mobile receiver means for decompressing said one message in said data packet signal (16.20.22), and an audio playback device (78) connected to said data decompression means for audibly reproducing said one message.

25. The apparatus according to claim 24 including a receiver memory means (74) connected between said data decompression circuit (72) and said audio playback device (78) for storing said one message in decompressed form.

26. The apparatus according to claim 24 including a digital/analog converter means (76) connected between said data decompression circuit (72) and said audio playback device (78) for converting said one message from digital form to analog form.

* * * * *